US005227852A

United States Patent [19]

Smith et al.

[11] Patent Number: 5,227,852

[45] Date of Patent: Jul. 13, 1993

[54] TRANSFER BLADE IN AN ELECTRONIC REPROGRAPHIC PRINTING SYSTEM

[75] Inventors: Robin E. Smith, Webster; James D. Apolito, Rochester; James R. Cassano, Penfield; George F. Rittberg, Macedon; David K. Ahl, Rochester; Dan F. Lockwood, Ontario; Kenneth G. Christy; Robert J. Tannascoli, both of Webster, all of N.Y.

[73] Assignee: Xerox Corporation, Stamford, Conn.

[21] Appl. No.: 755,412

[22] Filed: Sep. 5, 1991

[51] Int. Cl.[5] ..... G03G 15/14

[52] U.S. Cl. ..... 355/273; 355/271

[58] Field of Search ..... 355/326, 271, 273, 277, 355/274, 272, 77, 309; 430/199, 235, 252

[56] References Cited

U.S. PATENT DOCUMENTS

| | | | |
|---|---|---|---|
| 4,101,212 | 7/1978 | Sumiyoshi et al. | 355/274 |
| 4,131,358 | 12/1978 | Windele | 355/274 |
| 4,355,881 | 10/1982 | Tarumi et al. . | |
| 4,362,378 | 12/1982 | Erskine et al. | 355/274 |
| 4,415,257 | 11/1983 | Kopp et al. | 355/277 |
| 4,849,795 | 7/1989 | Spehrley, Jr. et al. | 355/271 X |
| 4,875,069 | 10/1989 | Takada et al. | 355/271 |
| 4,876,572 | 10/1989 | Nagatsuna | 355/210 |
| 4,891,680 | 1/1990 | Gross et al. | 355/309 |
| 4,943,863 | 7/1990 | Ainoya | 355/271 |
| 4,947,214 | 8/1990 | Baxendell et al. | 355/274 |
| 5,081,501 | 1/1992 | Waki et al. | 355/274 |

FOREIGN PATENT DOCUMENTS

| | | | |
|---|---|---|---|
| 0169870 | 9/1985 | Japan | 355/273 |

*Primary Examiner*—A. T. Grimley
*Assistant Examiner*—Sandra L. Brasé
*Attorney, Agent, or Firm*—Kenyon & Kenyon

[57] ABSTRACT

A transfer blade apparatus for ironing a sheet against the photoreceptor belt during transfer, and smoothing out deformities which cause deletions is disclosed. The transfer blades include a flexible tip to absorb the impact of the blade as it contacts paper, and a spring load to limit and control the force applied to the sheet. Sensors are also utilized to monitor and adjust the timing of the blades.

13 Claims, 16 Drawing Sheets

TRANSFER BLADE IN AN ELECTRONIC REPROGRAPHIC PRINTING SYSTEM

BACKGROUND OF THE INVENTION

The invention relates generally to a color electronic reprographic printing system, and more particularly concerns apparatus for optimizing the contact between paper or other copy media and a photoconductive surface.

The marking engine of an electronic reprographic printing system is frequently an electrophotographic printing machine. In an electrophotographic printing machine, a photoconductive member (often a photoreceptor belt) is charged to a substantially uniform potential to sensitize the surface thereof. The charged portion of the photoconductive member is thereafter selectively exposed. Exposure of the charged photoconductive member dissipates the charge thereon in the irradiated areas. This records an electrostatic latent image on the photoconductive member corresponding to the informational areas contained within the original document being reproduced. After the electrostatic latent image is recorded on the photoconductive member, the latent image is treated with toner particles and is subsequently transferred to a copy sheet. The copy sheet is heated to permanently affix the toner image thereto in image configuration.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner of a color complementary thereto. This process is repeated a plurality of cycles for differently colored images and their respective complementarily colored toner. Each single color toner image is transferred to the copy sheet in superimposed registration with the prior toner image. This creates a multi-layered toner image on the copy sheet. Thereafter, the multi-layered toner image is permanently affixed to the copy sheet creating a color copy. The developer material may be a liquid or a powder material.

In the process of black and white printing, the copy sheet is advanced from an input tray to a path internal to the electrophotographic printing machine where a toner image is transferred thereto and then to an output catch tray for subsequent removal therefrom by the machine operator. In the process of multi-color printing, the copy sheet moves from an input tray through a recirculating path internal to the printing machine where a plurality of toner images is transferred thereto and then to an output catch tray for subsequent removal. With regard to multi-color printing, a gripper bar secured to a transport receives the copy sheet and transports it in a recirculating path enabling the plurality of different color images to be transferred thereto. The gripper bar grips one edge of the copy sheet and moves the sheet in a recirculating path so that accurate multi-pass color registration is achieved. In this way, magenta, cyan, yellow, and black toner images are transferred to the copy sheet in registration with one another.

As the copy paper is left exposed to its environment, humidity can cause it to pucker. Other surface irregularities may be caused by mishandling of the copy stock and duplexing. These localized deformities can create an air gap between the paper and the photoreceptor belt. Such gaps result in the poor transfer of toner from the belt to the paper, which may manifest itself in deletions or distortions of information. Flipping the paper over, or discarding the old paper and adding fresh paper offer possible solutions to this problem. However, such rotation of paper stock is inherently expensive in paper costs, labor, and down time. A means for reducing the need for operator involvement and reducing the amount of paper that is wasted is needed.

A device which applies a force against the back of a sheet in transfer and flattens it against the photoreceptor belt is one possible solution to the problem. The Xerox Corporation 5090 machine uses a device which uses four flexible Mylar TM blade segments, each of which is deflected back away from the photoreceptor belt by solenoid actuated mechanisms. One or more of the solenoids are activated by the passage of a sheet, depending on the paper size being used. The force applied against the sheet is a function of the deflection of the mylar blade. Since the blades of these machines are held in a deflected-back state both during standby and between each copy, the mylar may tend to take on a permanent set over time, decreasing the force applied. This may result in the degradation in performance, over time, of the blades, and the need to replace the blades frequently.

There remains a need for a device that will provide enhanced contact between a copy sheet and a photoreceptor belt that is reliable and requires little maintenance.

SUMMARY OF THE INVENTION

The problems are overcome by the method and apparatus of the invention. A pair of solenoid actuated transfer blades are provided on the upper horizontal surface of a TRTL (two roll transfer loop) extrusion. These blades pivot about a common pivot rod which transverses the TRTL from its inboard side (the side facing the back of the machine) to its outboard side (the side facing the front of the machine). Each blade is equipped with an additional Mylar TM or other similar elastic plastic edge that is less rigid than the underlying blade.

The actuating mechanism is a mounting bracket with a solenoid and a shaft that is a common pivot for a solenoid link and a blade actuating lever. This link is connected at one end to the solenoid along with a torsion spring for returning the overall mechanism to its initial position after each cycle. At is other end, the link is connected to the blade actuating lever along with another torsion spring which provides a constant load to the blade during the caming action of the blade against the paper. A third link connects the blade actuating lever to the blade.

The transfer blade uses a mylar blade which remains undeflected when at rest or between copies, resulting in longer blade life. The mechanism also employs a load spring which provides for more consistent and gradual loading, so as to minimize toner disruption.

The invention controls the position where the blade touches down against the sheet and drops away from the sheet. Caming up too early can cause the blade to run into the gripper bar, leading to a possible copy quality defect. Dropping away from the trail edge too late can cause the blade to rub on the photoreceptor belt. This can contaminate the blade and subsequent copies. Also, if this continues for an extended period of time, it can cause damage to the photoreceptor belt which will show up as a copy quality defect.

Accordingly, the timing of the solenoids and transfer blades is determined by reference to a table of electronically stored previous actuation and deactuation times. Those values are acquired by a sensor mounted within each transfer blade actuation device.

The invention offers the following advantages:

A flexible blade tip provides a gentle application of the load and prevents the image from being disturbed when the blade touches down A spring loaded mechanism provides a more consistent applied load.

When the blade is at rest, the flexible tip is not deflected, leading to a longer blade life.

Using the maximum and minimum values of response times make it unlikely that the blade could come up too soon and collide with the gripper bar, or stay up too long and become contaminated by or damage the photoreceptor belt.

DETAILED DESCRIPTION

Figure 1:
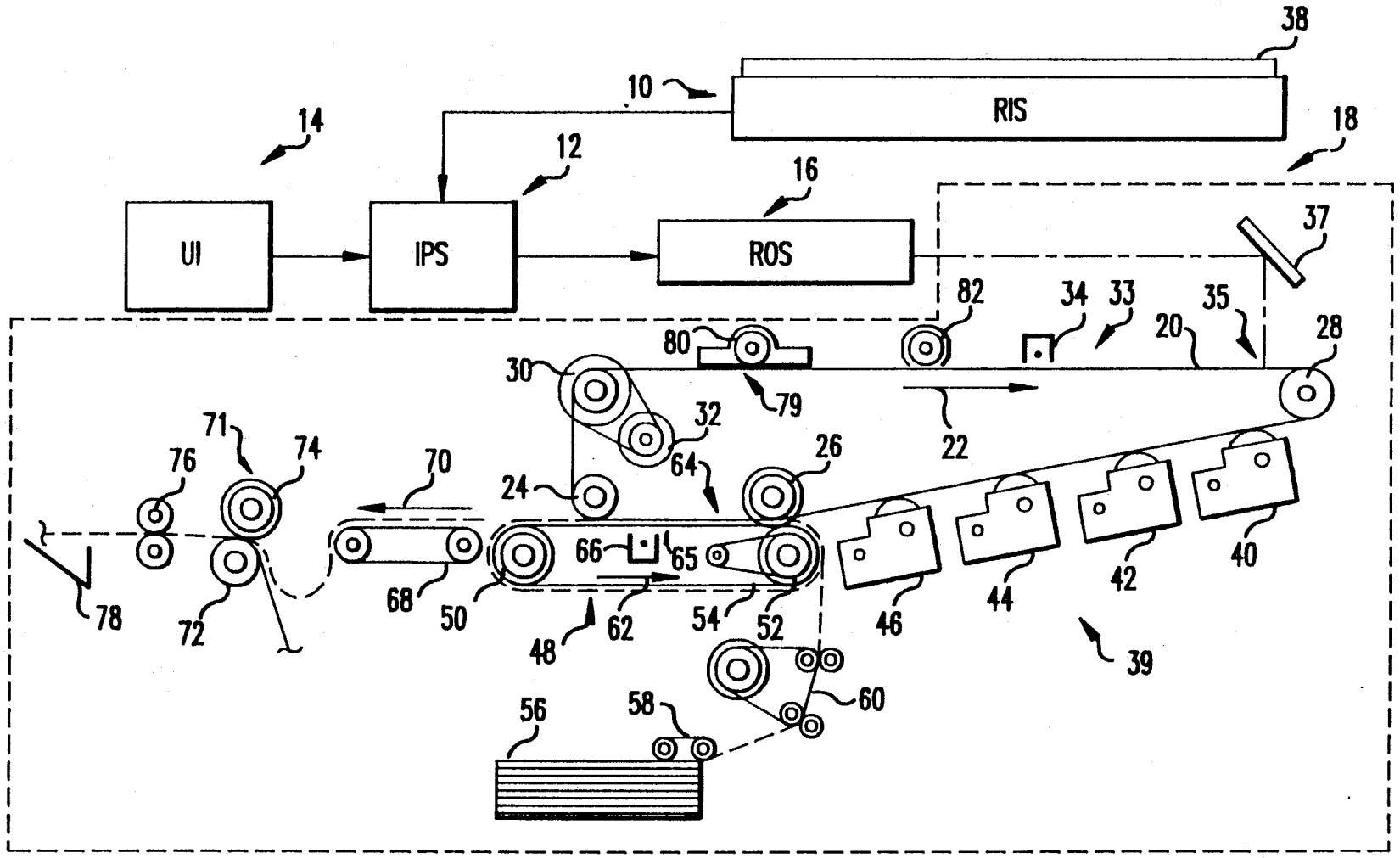
FIG. 1 is a schematic elevational view illustrating an electrophotographic printing machine incorporating the features of the present invention therein.

For a general understanding of the features of the present invention, reference is made to the drawings. In the drawings, like references have been used throughout to designate identical elements. FIG. 1 is a schematic elevational view of an illustrative electrophotographic machine incorporating the features of the present invention therein. It will become evident from the following discussion that the present invention is equally well suited for use in a wide variety of printing systems, and is not necessarily limited in its application to the particular system shown herein.

Turning initially to FIG. 1, during operation of the printing system, a multi-color original document 38 is positioned on a raster input scanner (RIS), indicated generally by the reference numeral 10. The RIS contains document illumination lamps, optics, a mechanical scanning drive, and a charge coupled device (CCD) array. The RIS captures the entire original document and converts it to a series of raster scan lines and measures a set of primary color densities, i.e. red, green, and blue densities, at each point of the original document. This information is transmitted to an image processing system (IPS), indicated generally by the reference numeral 12. IPS 12 contains control electronics that prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The output signal from UI 14 is transmitted to IPS 12. A signal corresponding to the desired image is transmitted from IPS 12 to ROS 16, which creates the output copy image. ROS 16 lays out the image in a series of horizontal scan lines with each line having a specified number of pixels per inch. ROS 16 includes a laser and an associated rotating polygon mirror block. ROS 16 exposes a charged photoconductive belt 20 of a printer or marking engine, indicated generally by the reference numeral 18, to achieve a set of subtractive primary latent images. The latent images are developed with cyan, magenta, and yellow developer material, respectively. These developed images are transferred to a copy sheet in superimposed registration with one another to form a multi-colored image on the copy sheet. This multi-colored image is then fused to the copy sheet forming a color copy.

With continued reference to FIG. 1, printer or marking engine 18 is an electrophotographic printing machine. Photoconductive belt 20 (also known as a photoreceptor belt) of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 2B, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform electrostatic potential.

Next, the charged photoconductive surface is rotated to an exposure station, indicated generally by the reference numeral 35. Exposure station 35 receives a modulated light beam corresponding to information derived by RIS 10 having a multi-colored original document 38 positioned thereat. RIS 10 captures the entire image from the original document 38 and converts it to a series of raster scan lines, which are transmitted as electrical signals to IPS 12. The electrical signals from RIS 10 correspond to the red, green, and blue densities at each point in the original document. IPS 12 converts the set of red, green, and blue density signals, i.e., the set of signals corresponding to the primary color densities of original document 38, to a set of calorimetric coordinates. The operator actuates the appropriate keys of UI 14 to adjust the parameters of the copy. UI 14 may be a touch screen, or any other suitable control panel, providing an operator interface with the system. The output signals from UI 14 are transmitted to IPS 12. The IPS then transmits signals corresponding to the desired image to ROS 16. ROS 16 includes a laser with rotating polygon mirror blocks. Preferably, a nine facet polygon is used. ROS 16 illuminates, via mirror 37, the charged portion of photoconductive belt 20 at a rate of about 400 pixels per inch. The ROS will expose the photoconductive belt to record three latent images. One latent image is adapted to be developed with cyan developer material. Another latent image is adapted to be developed with magenta developer material and the third latent image is adapted to be developed with yellow developer material. The latent images formed by ROS 16 on the photoconductive belt correspond to the signals transmitted from IPS 12.

After the electrostatic latent images have been recorded on photoconductive belt 20, the belt advances such latent images to a development station, indicated generally by the reference numeral 39. The development station includes four individual developer units indicated by reference numerals 40, 42, 44, and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is closely adjacent the photoconductive belt, while in the non-operative position, the magnetic brush is spaced therefrom. In FIG. 1, developer unit 40 is shown in the operative position with developer units 42, 44, and 46 being in the non-operative position. During development of each electrostatic latent image, only one developer unit is in the operative position, the remaining developer units are in the non-operative position. This ensures that each electrostatic latent image is developed with toner particles of the appropriate color without commingling.

Figure 2:
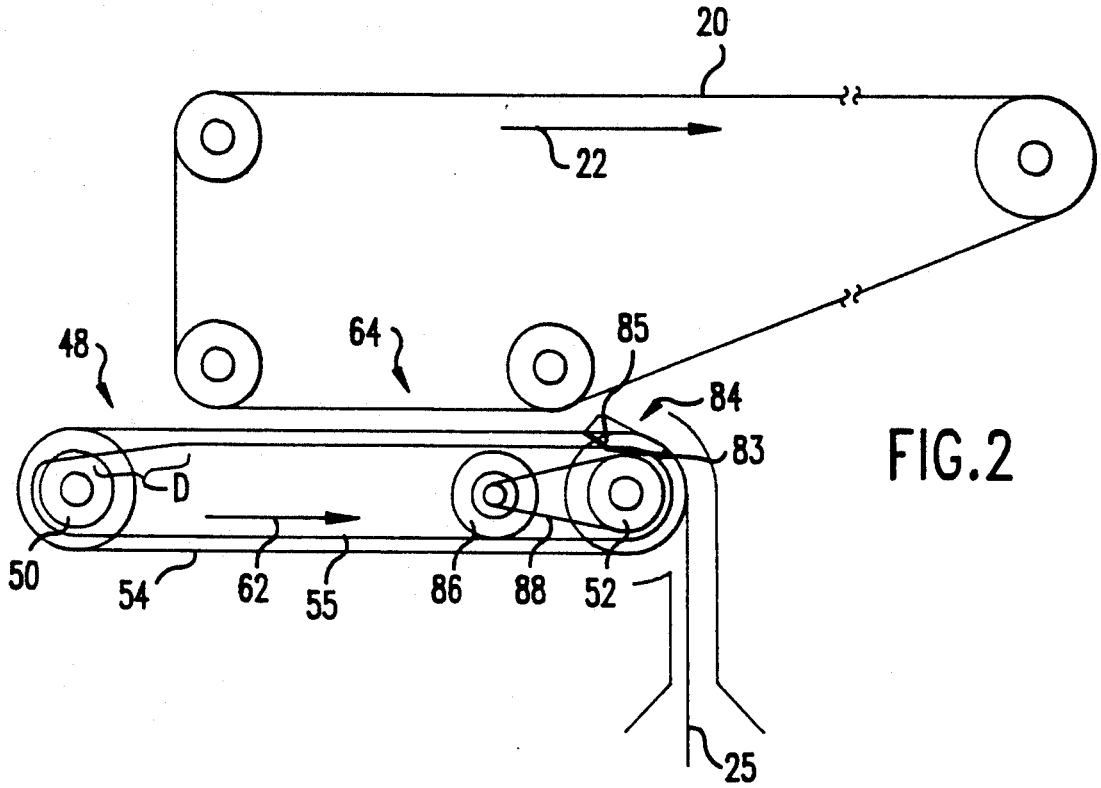
FIG. 2 is a schematic elevational view showing further details of the sheet transport system used in the electrophotographic printing machine of FIG. 1 and also showing the sheet gripper (the gripper bar) of the sheet transport system at a position prior to entering the transfer zone.
Figure 3:
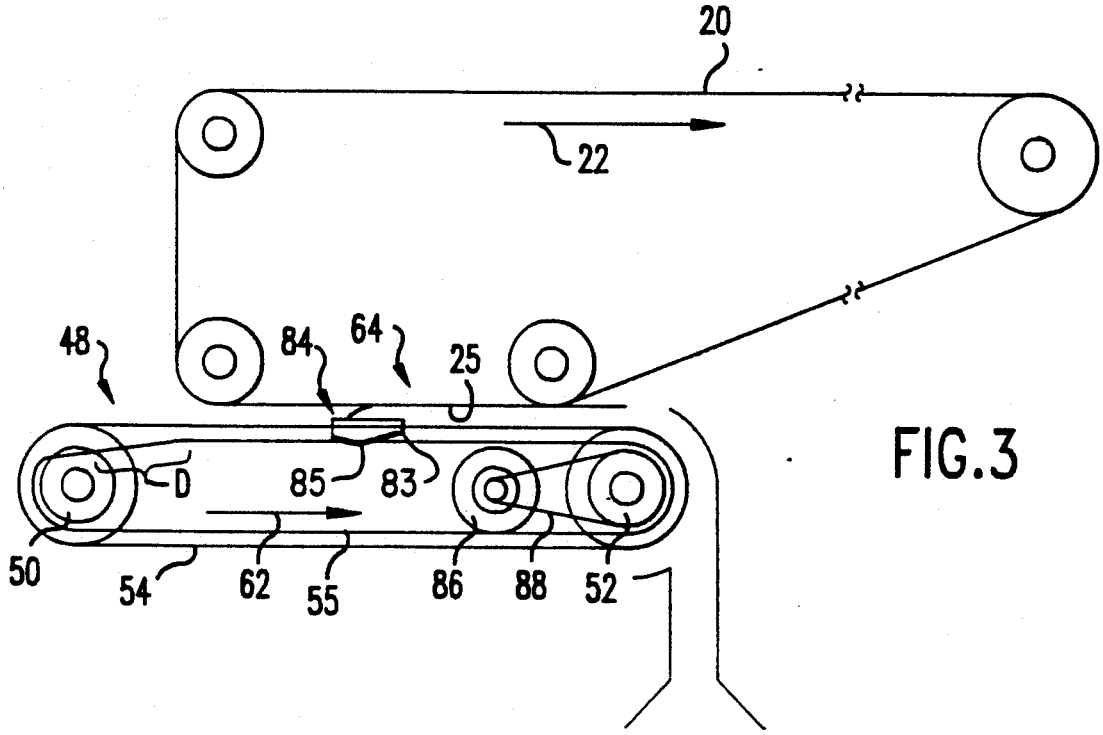
FIG. 3 is a schematic elevational view showing further details of the sheet transport system used in the electrophotographic printing machine of FIG. 1 and also showing the sheet gripper of the sheet transport system at a position within the transfer zone.

After development, the toner image is moved to a transfer station, indicated generally by the reference numeral 65. This transfer station may take the form of a two-roll transfer loop or TRTL. Transfer station 65 includes a transfer zone, generally indicated by reference numeral 64. In transfer zone 64, the toner image is transferred to a sheet of support material, such as plain paper or transparent plastic. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper, generally indicated by the reference numeral 84 (see FIGS. 2-3), extends between belts 54 and moves in unison therewith. A sheet 25 is advanced from a stack of sheets 56 disposed on a tray. A friction retard feeder 58 advances the uppermost sheet from stack 56 onto a pre-transfer transport 60. Transport 60 advances sheet 25 to sheet transport 48. Sheet 25 is advanced by transport 60 in synchronism with the movement of sheet gripper 84. In this way, the leading edge of sheet 25 arrives at a preselected position, i.e. a loading zone, to be received by the open sheet gripper. The sheet gripper then closes securing sheet 25 thereto for movement therewith in a recirculating path. The leading edge of sheet 25 is secured releasably by the sheet gripper. Further details of the sheet transport apparatus will be discussed hereinafter with reference to FIGS. 2-3. As belts 54 move in the direction of arrow 62, the sheet moves into contact with the photoconductive belt, in synchronism with the toner image developed thereon. At transfer zone 64, a corona generating device 66 sprays ions onto the backside of the sheet so as to charge the sheet to the proper electrostatic voltage magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another. One skilled in the art will appreciate that the sheet may move in a recirculating path for four cycles when under color black removal is used and up to eight cycles when the information on two original documents latent images recorded on the photoconductive surface is developed with the appropriately colored toner and transferred, in superimposed registration with one another, to the sheet to form the multi-color copy of the colored original document.

After the last transfer operation, the sheet gripper opens and releases the sheet. Sensor means are provided to indicate the location of the paper and gripper as a function of time. A conveyor 68 transports the sheet, in the direction of arrow 70, to a fusing station, indicated generally by the reference numeral 71, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to catch tray 78 for subsequent removal therefrom by the machine operator.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

Figure 4:
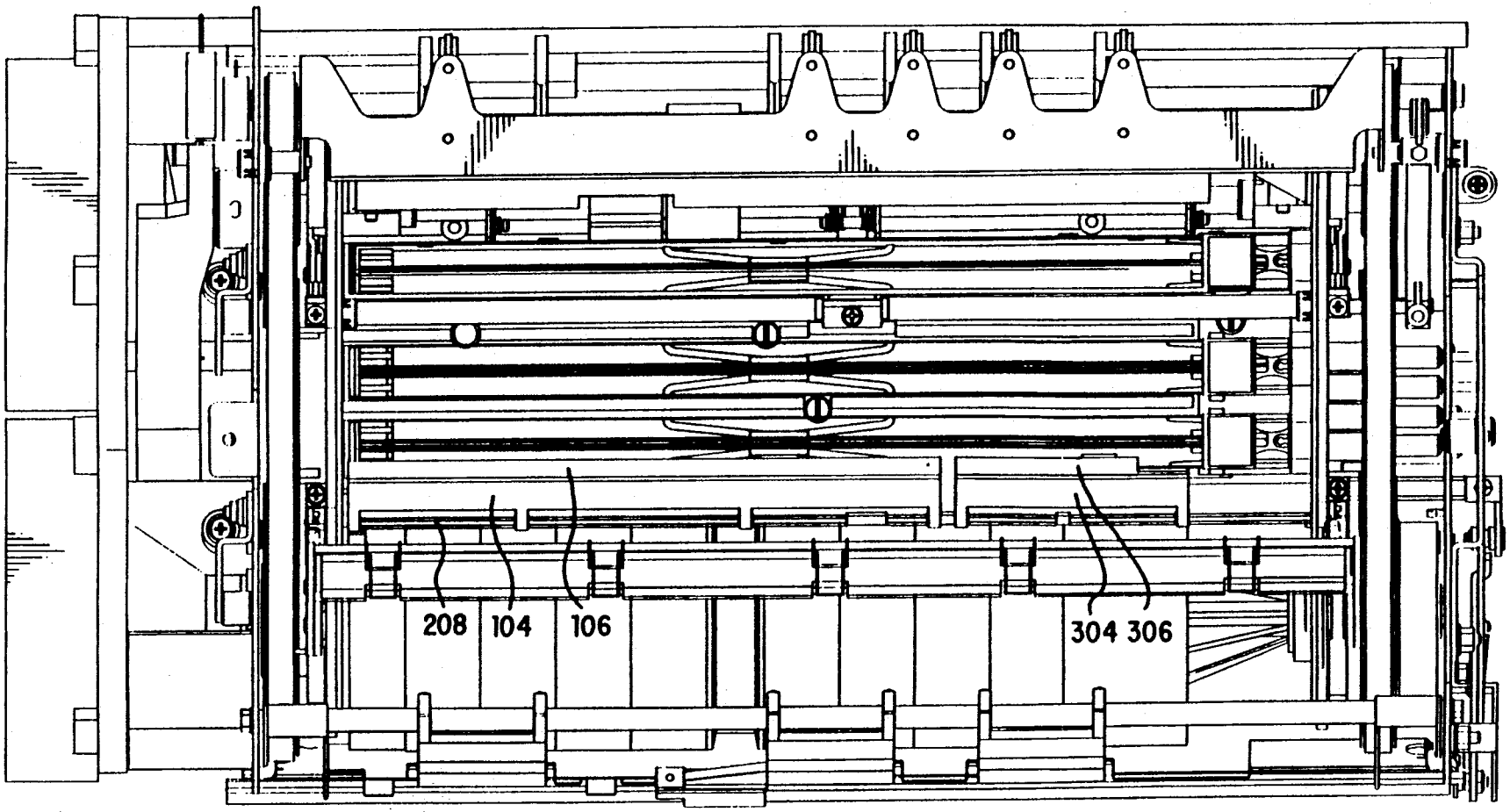
FIG. 4 is a top plan view of TRTL and transfer blade.
Figure 5:
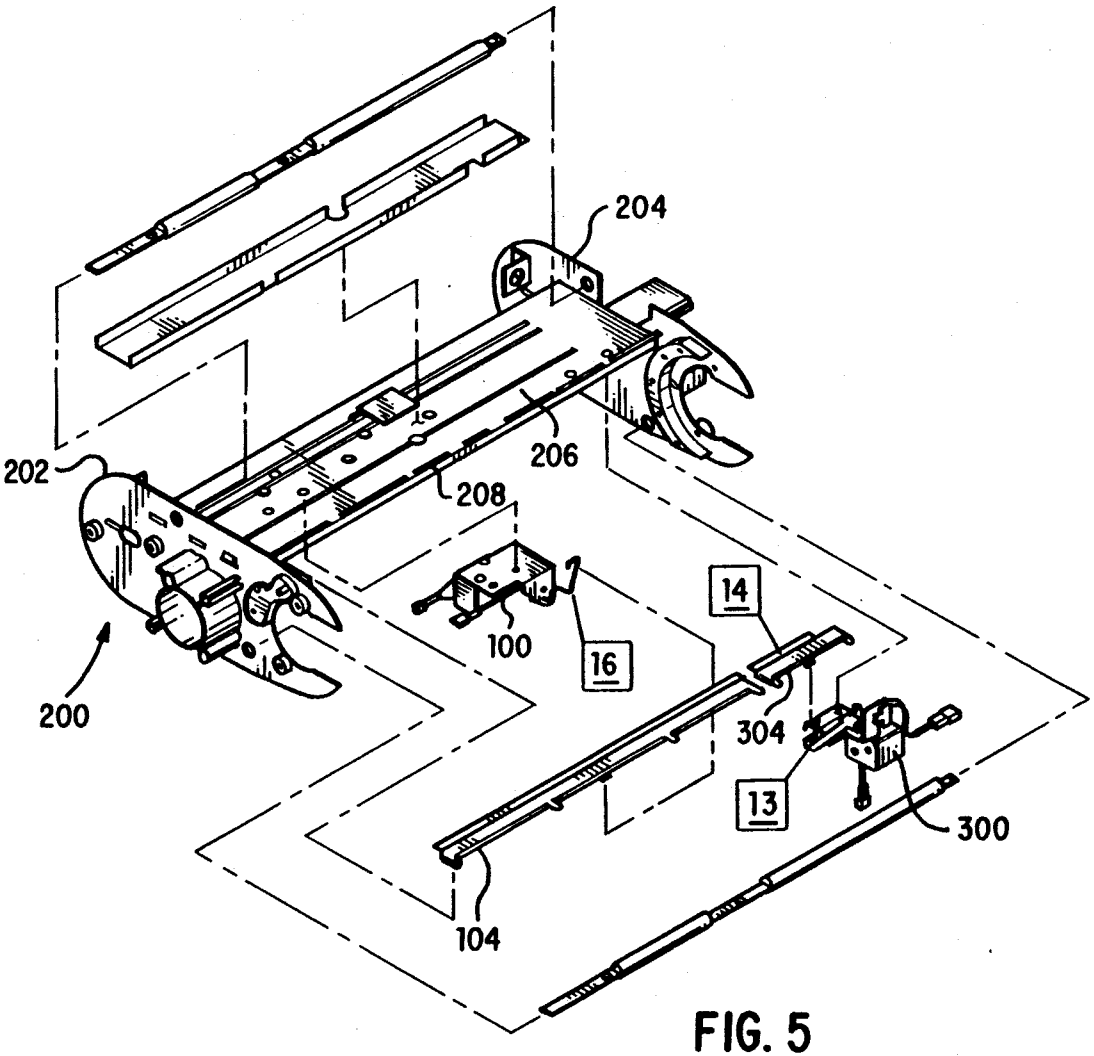
FIG. 5 is an exploded view of the TRTL mounting, transfer blades and solenoid modules showing the basic configuration of elements.
Figure 6:
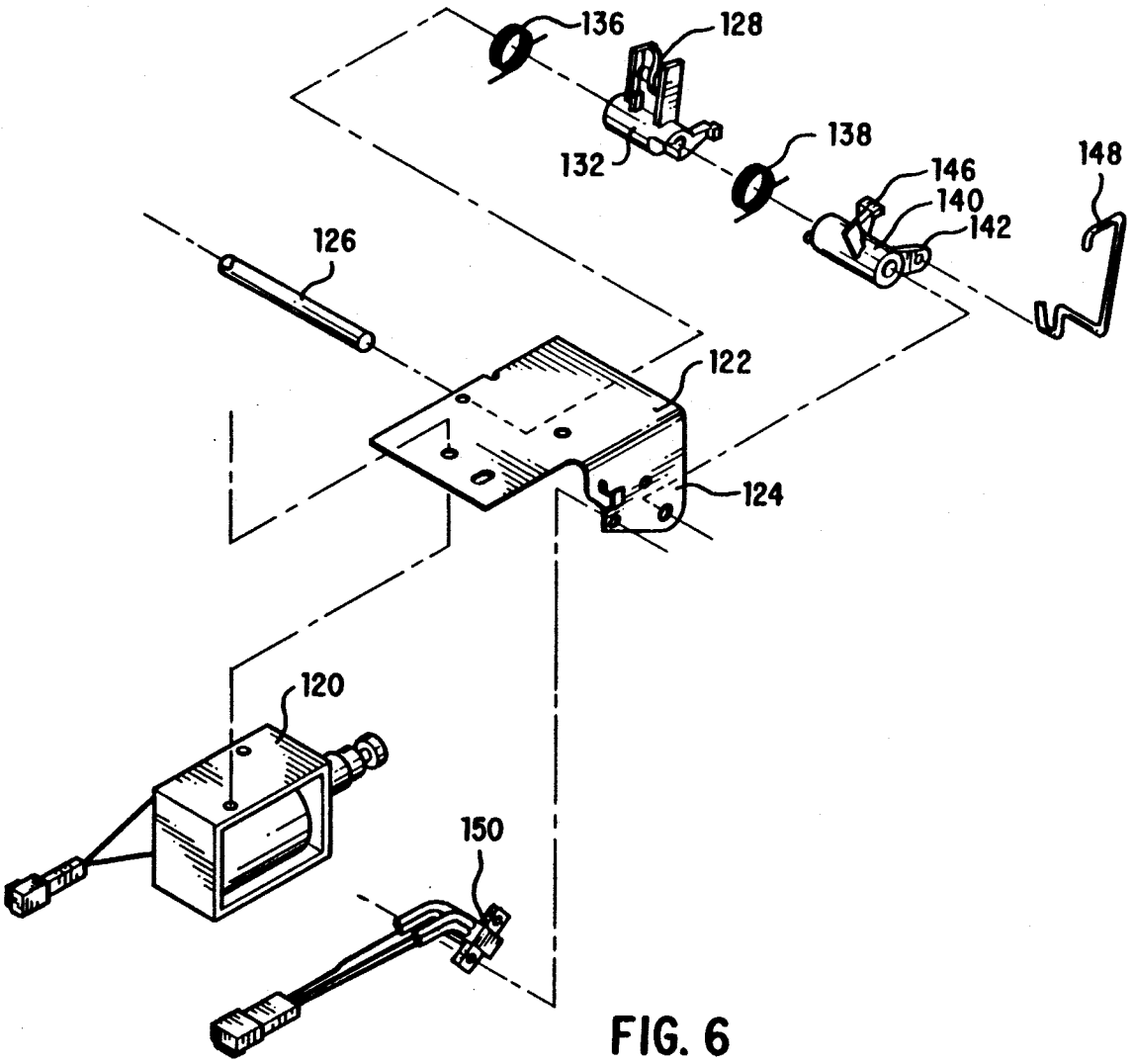
FIG. 6 is an exploded view of the outboard transfer blade module.
Figure 7:
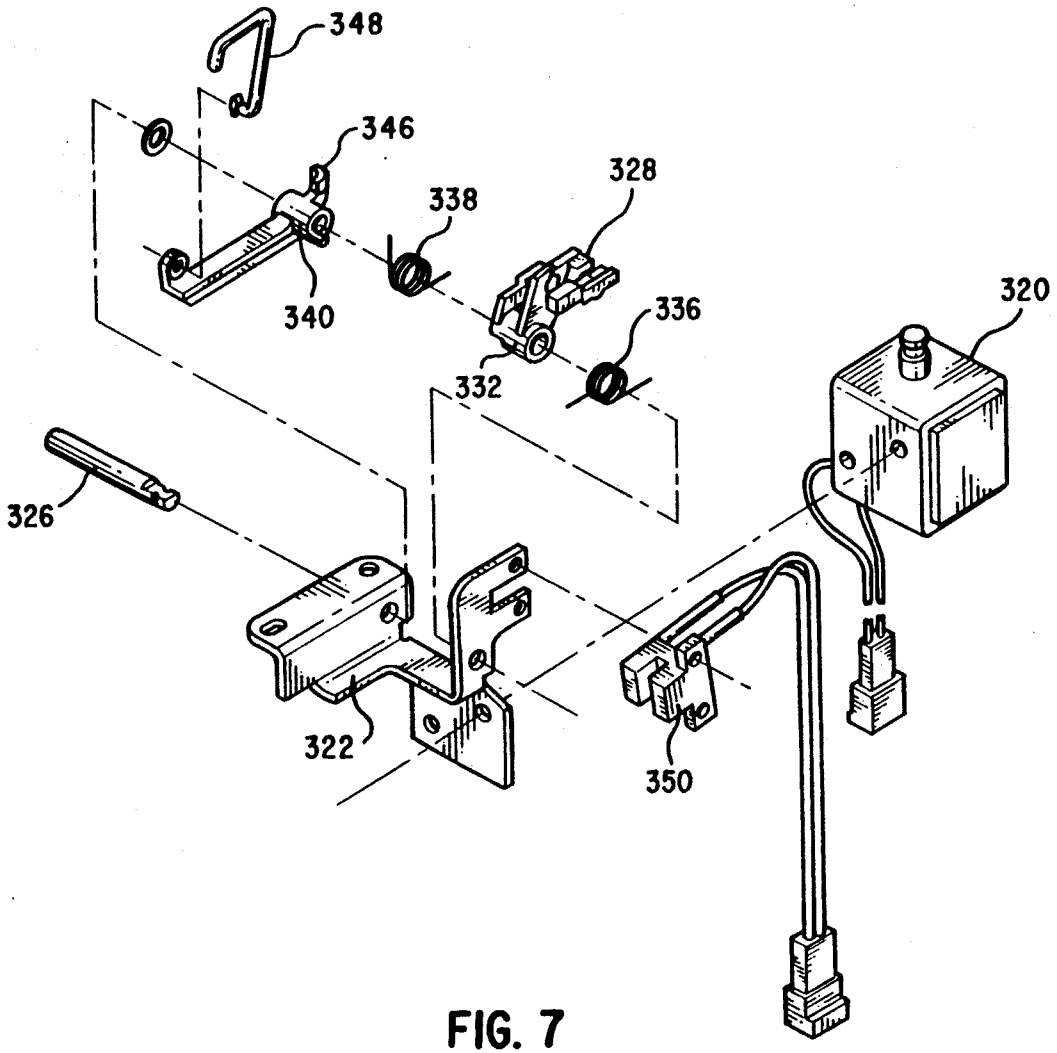
FIG. 7 provides an exploded view of the inboard transfer blade module.
Figure 8:
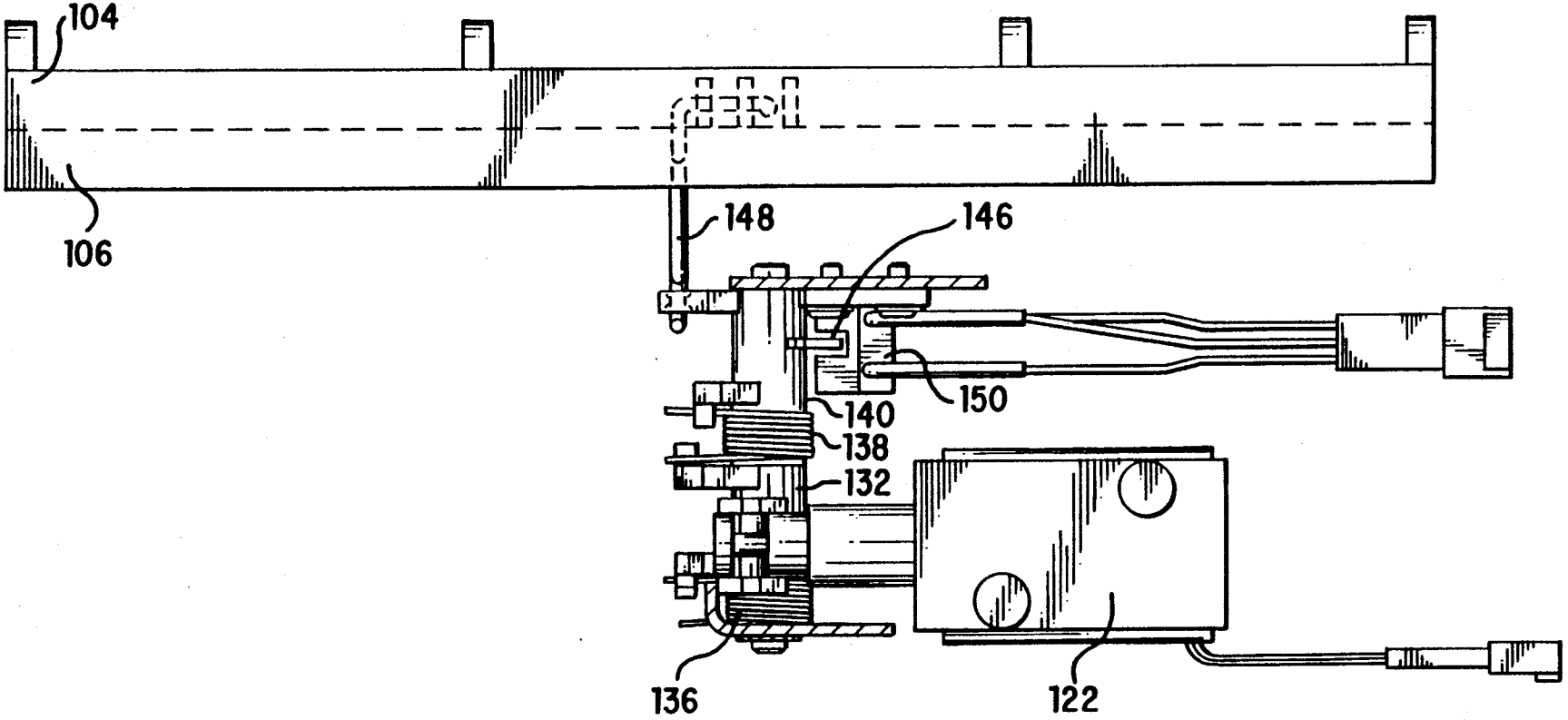
FIG. 8 provides an overhead view of the outboard transfer blade module.
Figure 9:
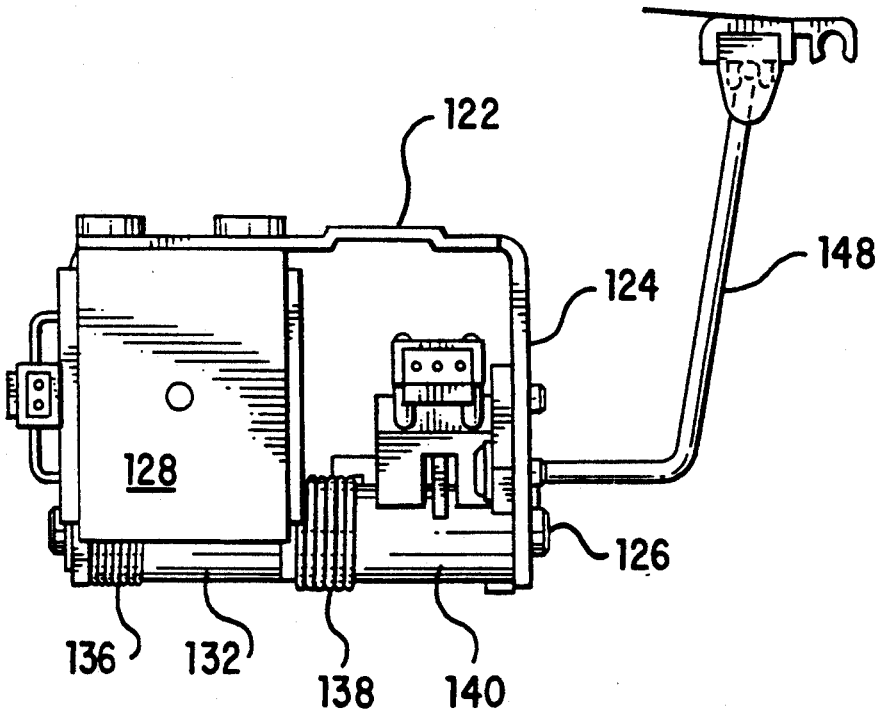
FIG. 9 provides a cross-sectional view of the outboard transfer blade module.
Figure 10:
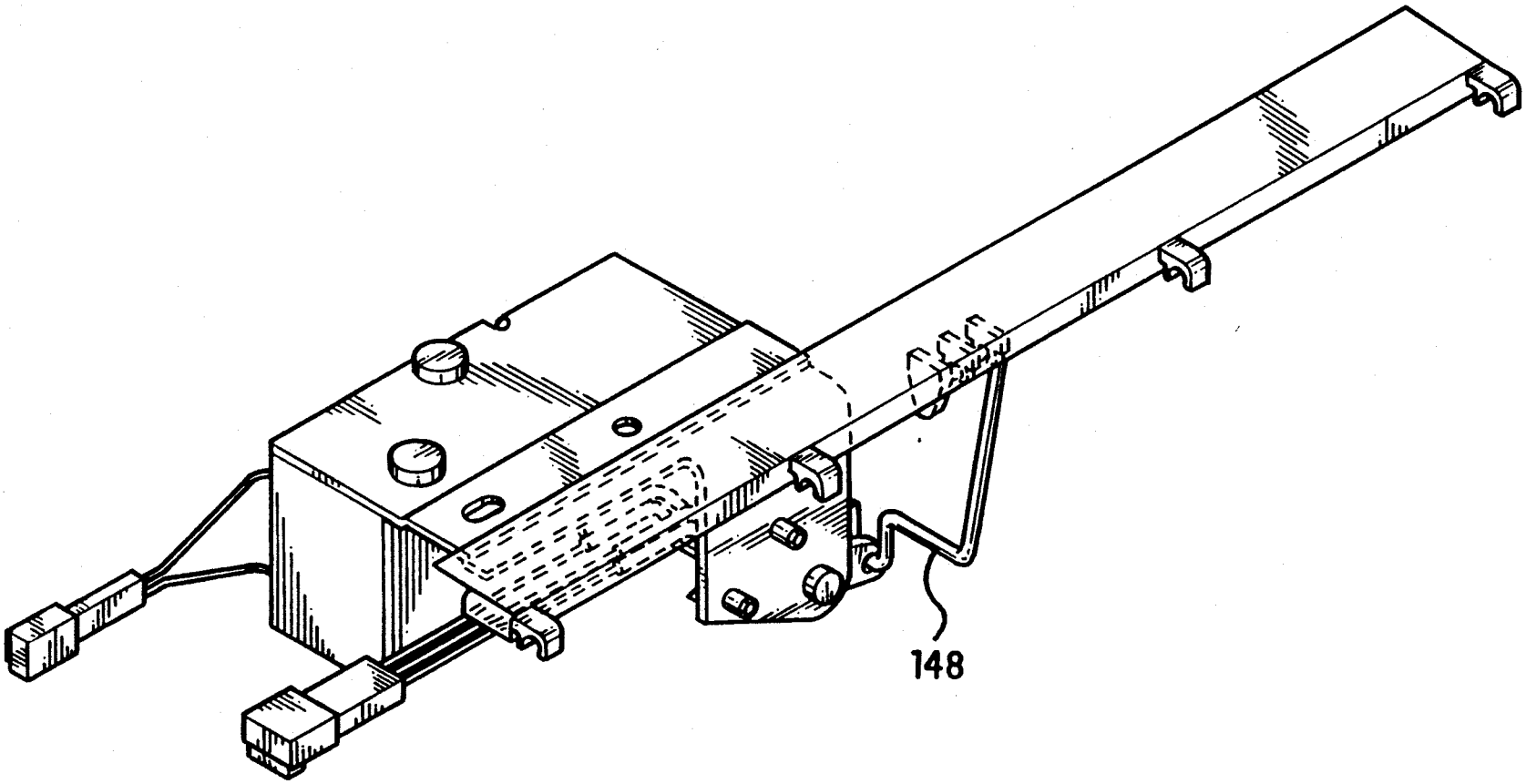
FIG. 10 shows the outboard transfer blade module in perspective.
Figure 11:
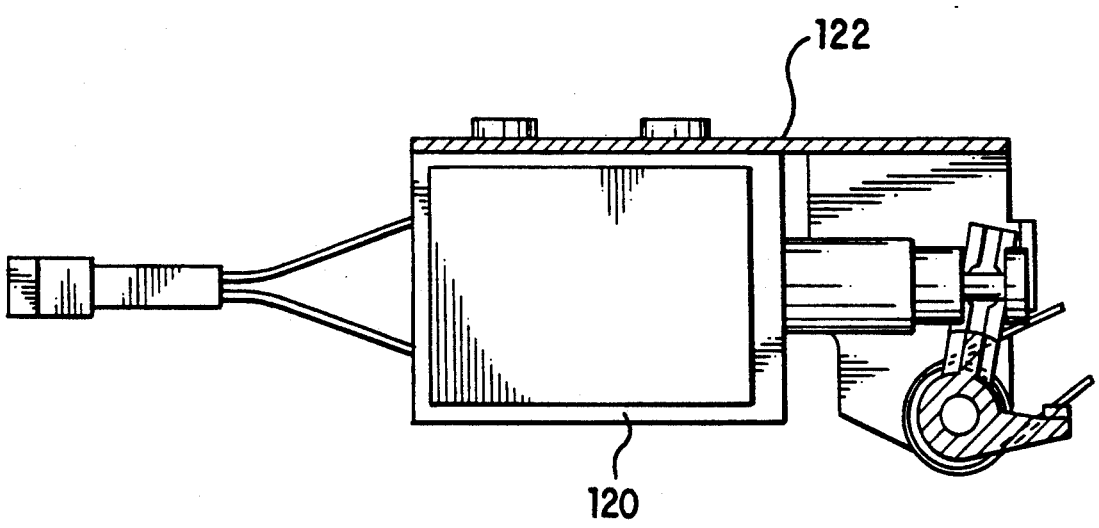
FIG. 11 shows an additional cross-sectional view of the outboard transfer blade module.
Figure 12:
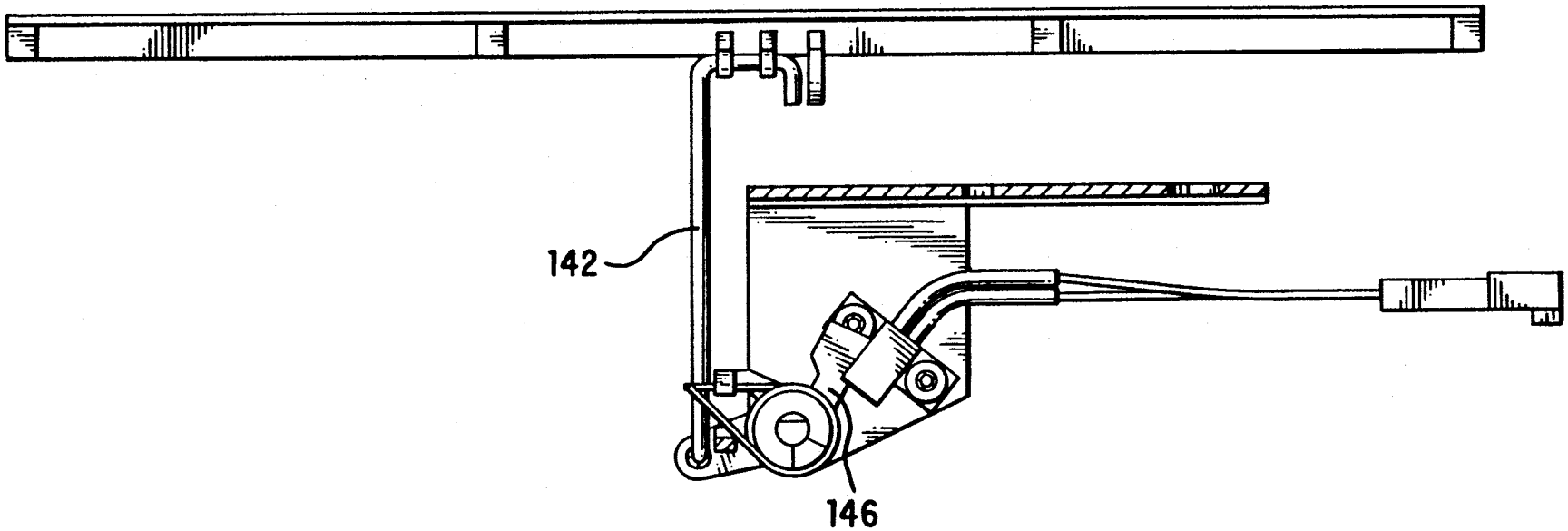
FIG. 12 shows the cross-sectional view of the outboard transfer blade module.
Figure 13:
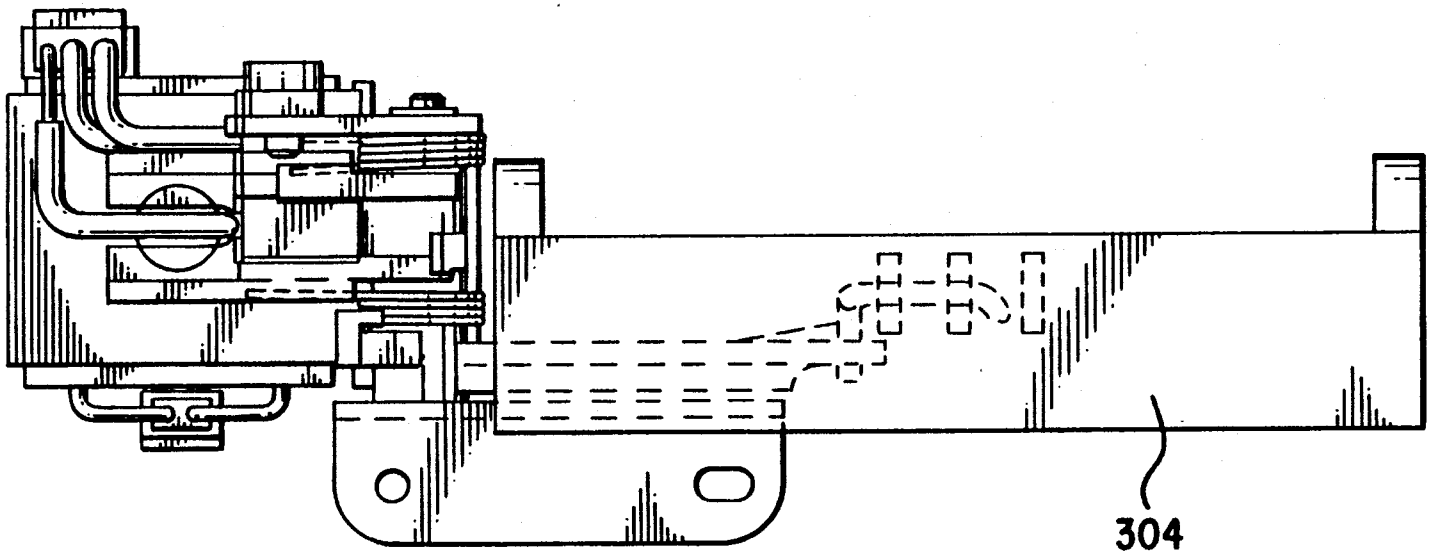
FIGS. 13–17 show similar views of the inboard transfer blade module.
Figure 14:
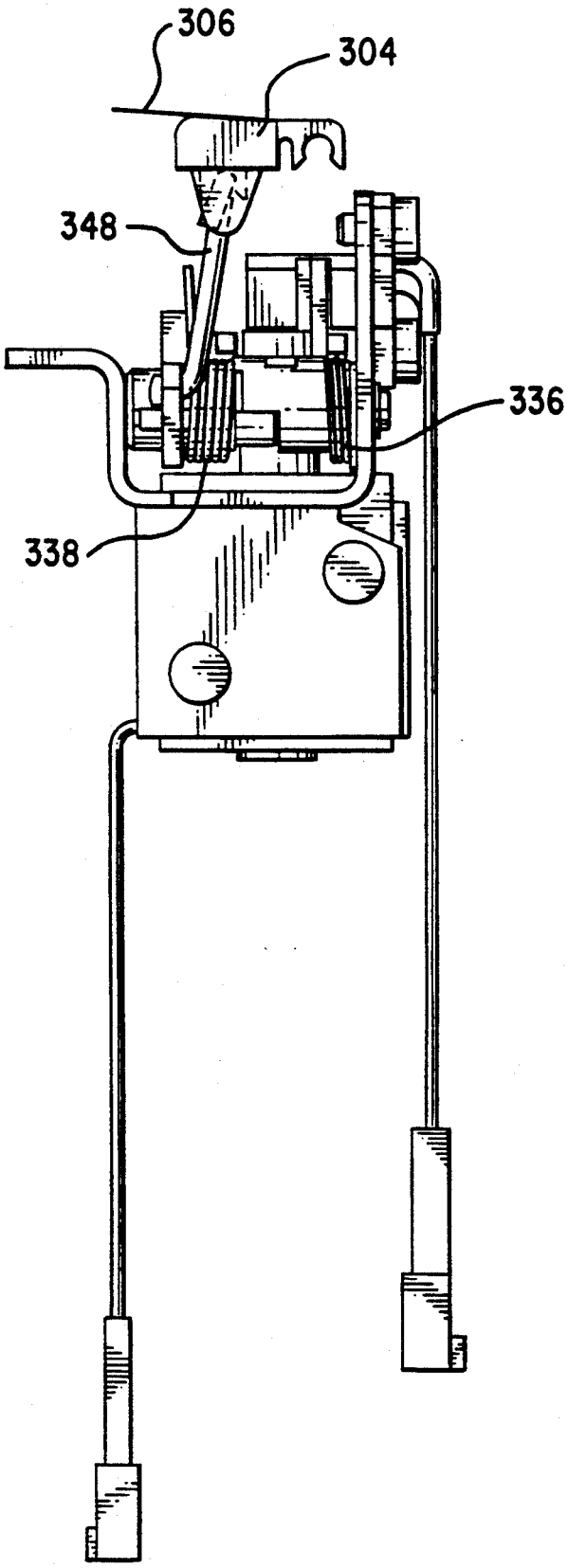
Figure 15:
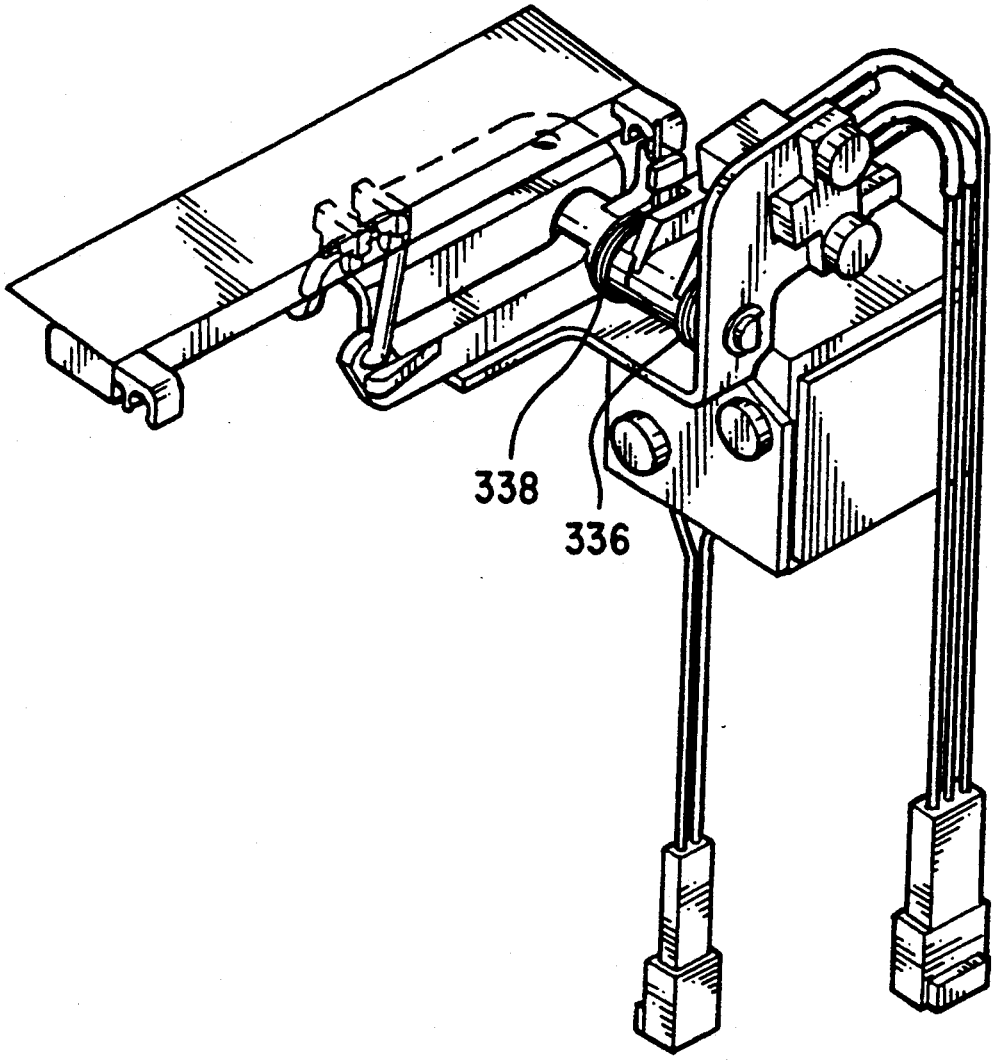
Figure 16:
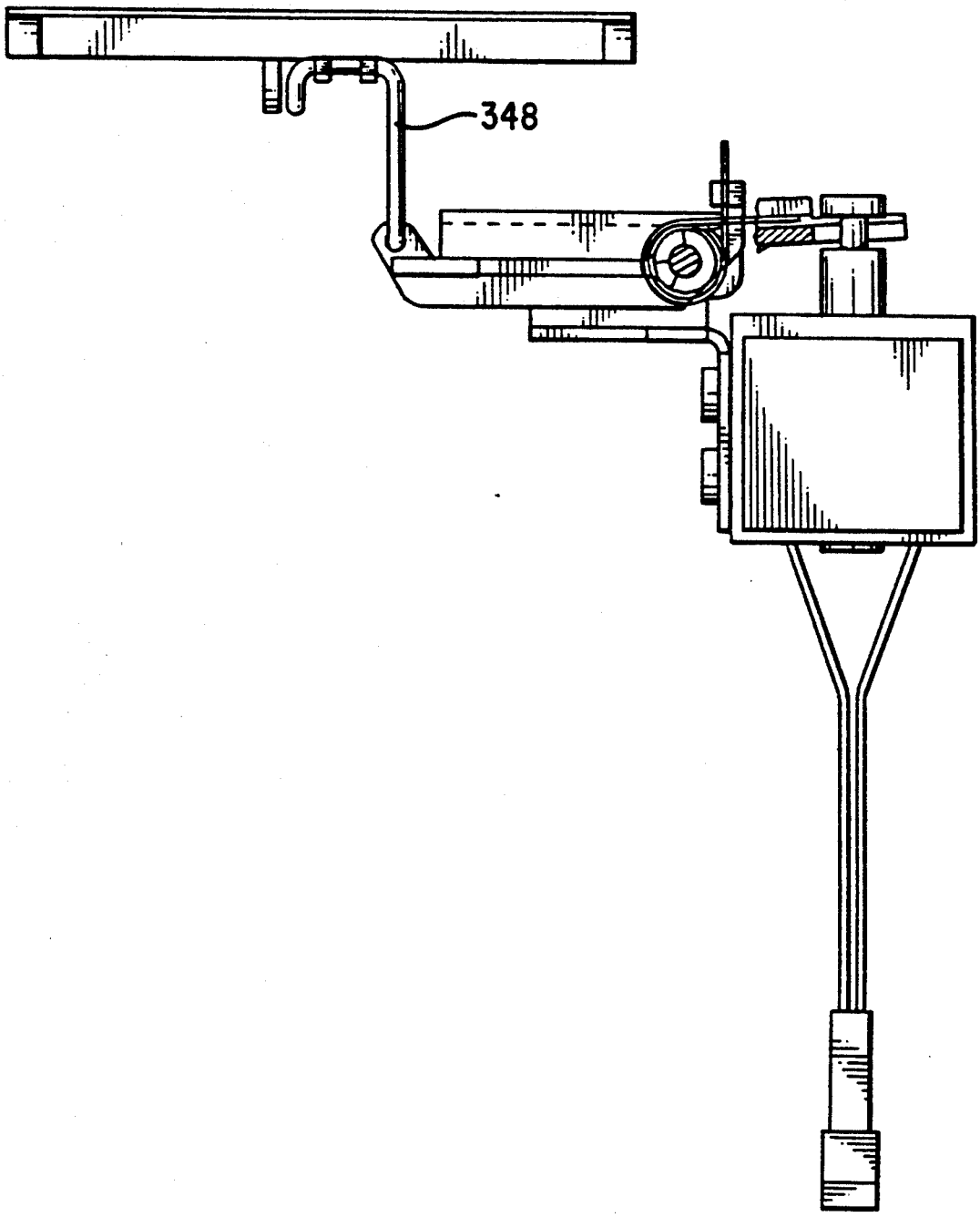
Figure 17:
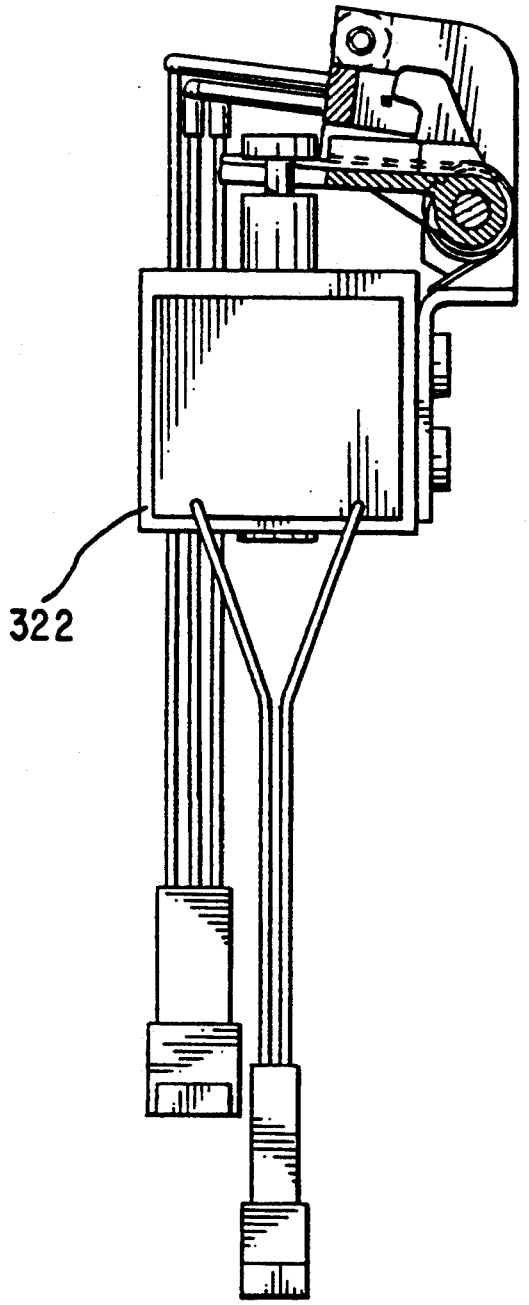

In order to compensate for any surface irregularity present in the copy material, a pair of outboard and inboard transfer blade modules 100 and 300 are provided to cam transfer blades 104 and 304 mounted on a pivot rod 208 attached to TRTL frame 200. (See FIGS. 4 and 5) As shall be explained further below, once the gripper bar has passed the transfer blades, they are camed up against the undersigned of the copy sheet, thereby pressing it against the photoreceptor for enhanced contact therewith. Before the copy sheet passes the transfer blades, the blades are camed down to their starting position, to avoid scraping the photoreceptor. Sensor means are provided to determine the position of the gripper bar and paper with respect to the TRTL.

The transfer blade apparatus utilizes two blade segments, inboard and outboard, each with it's own solenoid actuated mechanism. One, or both blades will be activated, depending on the size of the paper being run. When one feeds the short edge (typically 8½ in length or less) of a copy sheet to the TRTL, only the longer outboard transfer blade 104 need be cammed up. It is not desirable to cam up the other, shooter blade 304 when it is not needed, for then it would scrape the photoreceptor belt, and possibly damage it. When a longer copy sheet is fed into the system, both transfer blades can be cammed up to accommodate it. Thus, with just these two segments, a wide variety of copy sheet sizes may be accommodated.

The basic principle of both mechanisms 100 and 300 is identical. Actuation is provided by a solenoid 120 which converts a linear reciprocating motion into a rotation motion and which works on a series of three links. Solenoid 120 is mounted on the underside of a bracket 122 having depending side walls 124. Spanning side walls 124 is a pivot rod 126, over which are disposed two generally cylindrical links. The solenoid cooperates with solenoid lever 128 to pivot link 132 about pivot rod 126. One end of this link is coupled via coiled return spring 136 to one of the side walls 124. The other end of solenoid link 132 is coupled via coiled load spring 138 to a generally cylindrical action to link 140, which like 132, is free to rotates about an axis defined by the pivot rod 126.

Attached to actuator link 140 are actuator lever 142 and flag 146. Actuator lever 142 is provided with a hole by which it is coupled to a rigid blade link 148. This blade link protrudes through the extrusion 206 to a joint which connects it to the underside of the blade 104, which snaps onto and pivots about the TRTL pivot rod 208.

Actuation of the solenoid thus causes the three links to move in cooperation with the transfer blade to pivot the blade up against the copy sheet. The spring rate of the load spring is kept low so the load applied remains relatively constant over its entire range of motion. Attached in overlying relation to the blade holder 104 is a flexible mylar tip 106. When the solenoid is activated, the blade is raised up against the back of the sheet. The mylar will deflect to the level of preload on the load spring 138, then the load spring will deflect, providing a consistent level of force applied to the sheet. The other torsion return spring 136 in the mechanism returns the blade to its original position when the solenoid is de-energized.

As solenoids heat up during use, their reaction time can change significantly, both in terms of "pull-in" time (corresponding to blade-up), and "pull out" time (corresponding to blade-down). Since it is important to accurately control when the blade touches down and drops away from the sheet, it is necessary to measure the response time of the mechanism and update the time when the command to actuate the solenoid is executed. As the blade is raised, flag 146 attached to actuator link 140 passes through a sensor 150. This sensor provides a signal indicating when the flag is raised (blade up) or lowered (blade down). Software measures the time from when the command to raise the blade was executed, until the flag passes in front of the sensor. This measurement is stored in a table of 8 of the last measured values and is used when determining the time to activate the solenoid on the next pass. Similar measurements are taken when the solenoid is de-energized to control where the blade drops away from the sheet, relative to the trail edge. These measurements are also stored as a table of 8 values. Since the time between jobs could be long enough to allow the solenoid to cool, the response times will be checked each time start print is pressed, before any images are transferred. These numbers, too, will be electronically stored in the tables of values. Before camming the blade for the first image transfer, the tables are polled. The value used will be the minimum in the pickup time table and the maximum of the dropout time table. (Sensors monitor the location of the gripper and copy sheet about the TRTL.) This provides a margin of safety for the blade camming up too early and running into the gripper bar, or staying cammed too long and contacting the photoreceptor belt. (It is most likely with this scenario that the blade will take slightly longer than the minimum to cam up, therefore touching down slightly further into the sheet, and take slightly less time to drop out, therefore leaving the sheet slightly further in from the trail edge.)

The response times are measured on each actuation and are compared with allowable maximum and minimum values. If any of the values fall outside the allowable range, the blade will be disabled for the remainder of the current job, but will be reset to try again on the next job. Failure of the blade to pickup or dropout within the desired range will not cause the machine to shutdown.

While the invention has been described with reference to a specific embodiment, it will be apparent to those skilled in the art that many alternatives, modifications, and variations may be made. Accordingly, it is intended to embrace all such alternatives, modifications that may fall within the spirit and scope of the appended claims.

What is claimed is:

1. An apparatus for enhancing the contact between a copy sheet and a photoconductor, comprising:

a solenoid having a linear direction of actuation;

a means for housing the solenoid;

first and second pivot means disposed in said housing means, wherein said first and second pivot means are operatively connected to said solenoid so that the operation of the solenoid causes the first and second pivot means to rotate about a common axis of rotation;

an indicator means projecting from said second pivot means;

sensor means for detecting the presence of the indicator means;

a transfer blade; and means connecting the transfer blade to the second pivot means so that the rotation of the pivot results in the movement of the transfer blade.

2. The apparatus of claim 1, wherein the first pivot means is connected to the housing means by way of a spring means.

3. The apparatus of claim 1, wherein the first and second pivot means are connected to one another by a spring means.

4. The apparatus of claim 1, wherein the transfer blade includes an overlying sheet of material for providing a deflectable edge.

5. The apparatus of claim 1, comprising a pair of transfer blade actuators, each actuating a blade of differing length.

6. The apparatus of claim 1, wherein the transfer blade includes a flexible blade tip to help reduce impact between the transfer blade and the photoconductor.

7. A method of enhancing the contact between a copy sheet and a photoreceptor, comprising the steps of:

feeding the copy sheet to a transfer means equipped with a gripper means;

sensing the location of the gripper means with respect to a transfer blade;

issuing a command to cam up the transfer blade after the gripper means has passed; and issuing a command to cam down the transfer blade before the copy sheet has passed.

8. A method of enhancing the contact between a copy sheet and a photoreceptor, comprising the steps of:

feeding the copy sheet to a transfer means equipped with a gripper means;

sensing the location of the gripper means with respect to a transfer blade;

issuing a command to cam up the transfer blade after the gripper means has passed; and issuing a command to cam down the transfer blade before the copy sheet has passed, wherein each time the transfer blade is cammed up and cammed down, the time between the issuance of the actuation/deactuation command and the camming action is measured, and the issuance of an actuation or deactuation command on the next cycle is timed as a function of the previous actuation times.

9. An apparatus for enhancing the contact between a copy sheet and a photoconductor, comprising:

a solenoid having a linear direction of actuation;

a means for housing the solenoid;

first and second pivot means disposed in said housing means, wherein said first and second pivot means are operatively connected to said solenoid so that the operation of the solenoid causes the first and second pivot means to rotate about a common axis of rotation and wherein the first pivot means is connected to the housing means by way of a spring means;

a transfer blade; and means connecting the transfer blade to the second pivot means so that the rotation of the pivot results in the movement of the transfer blade.

10. The apparatus of claim 9, further comprising a flag projecting from said second pivot means, and sensor means for detecting the presence of the flag.

11. The apparatus of claim 9, wherein the first and second pivot means are connected to one another by a spring means.

12. The apparatus of claim 9, wherein the transfer blade includes an overlying sheet of material for providing a deflectable edge.

13. The apparatus of claim 9, wherein the transfer blade includes a flexible blade tip to help reduce impact between the transfer blade and the photoconductor.

* * * * *

UNITED STATES PATENT AND TRADEMARK OFFICE

CERTIFICATE OF CORRECTION

PATENT NO. : 5,227,852

DATED : Jul. 13, 1993

INVENTOR(S) : Robin E. Smith, et al

It is certified that error appears in the above-indentified patent and that said Letters Patent is hereby corrected as shown below:

| Column | Line | |
|---|---|---|
| 2 | 54 | Change "caming" to --camming--. |
| 2 | 64 | Change "Caming" to --Camming--. |
| 4 | 48 | Change "2B" to --28--. |
| 6 | 53 | Change "under color" to --undercolor--. |
| 6 | 55 | Change "documents" to --documents'--. |
| 7 | 23 | Change "camed" to --cammed--. |
| 7 | 26 | Change "camed" to --cammed--. |
| 7 | 47 | After "motion" delete "and". |
| 7 | 57 | Change "rotates" to --rotate--. |
| 8 | 55 | Change "pickup" to --pick up--; change "dropout" to --drop out--. |

Signed and Sealed this

Twelfth Day of April, 1994

Bruce Lehman

*Attest:*

BRUCE LEHMAN

*Commissioner of Patents and Trademarks*

*Attesting Officer*